US006695709B1

(12) United States Patent
Ottensmeyer

(10) Patent No.: US 6,695,709 B1
(45) Date of Patent: Feb. 24, 2004

(54) PUTTING TRAINING DEVICE

(76) Inventor: Richard C. Ottensmeyer, 608 Poinciana Dr., Gulf Breeze, FL (US) 32561

( * ) Notice: Subject to any disclaimer, the term of this patent is extended or adjusted under 35 U.S.C. 154(b) by 0 days.

(21) Appl. No.: 09/898,672

(22) Filed: Jul. 2, 2001

(51) Int. Cl.[7] ..... A63B 69/36
(52) U.S. Cl. ..... 473/258; 473/220
(58) Field of Search ..... 473/220, 226, 473/231, 258, 257, 266, 269, 261, 262, 263, 264, 265

(56) References Cited

U.S. PATENT DOCUMENTS

| | | | | |
|---|---|---|---|---|
| 2,303,736 | A | | 12/1942 | Hall |
| 3,073,602 | A | | 1/1963 | Bell |
| 3,191,939 | A | * | 6/1965 | Hooper |
| 3,844,569 | A | * | 10/1974 | Swanson |
| 3,863,933 | A | * | 2/1975 | Tredway |
| 4,133,535 | A | | 1/1979 | Marsh |
| 4,153,255 | A | | 5/1979 | Woodson |
| 4,334,684 | A | | 6/1982 | Sterling |
| 4,984,802 | A | * | 1/1991 | Barraclough |
| 5,074,565 | A | * | 12/1991 | Tucker |
| 5,125,844 | A | | 6/1992 | Grant et al. |
| 5,152,534 | A | | 10/1992 | Sindelar |
| D331,438 | S | | 12/1992 | Tucker |
| 5,230,512 | A | * | 7/1993 | Tattershall |
| 5,423,538 | A | | 6/1995 | Stewart |
| 5,776,007 | A | | 7/1998 | Kendall et al. |
| 5,827,125 | A | | 10/1998 | Lee |
| 5,919,096 | A | | 7/1999 | Kim |
| 6,036,608 | A | | 3/2000 | Morris |
| 6,350,207 | B1 | * | 2/2002 | Arcuri |

* cited by examiner

*Primary Examiner*—Gregory Vidovich
*Assistant Examiner*—Nini F. Legesse
(74) *Attorney, Agent, or Firm*—Peter Loffler

(57) ABSTRACT

A putter training device helps a golfer improve upon the putting game. The device has a first base member and a second base member connected by a shaft which may have a hollow section for receiving a laser pointing device therein for pinpointing the desired target of a shot. A pocket system uses a sleeve that slides along a length of the shaft and rotates about the shaft and has a pocket pivotally attached to the sleeve for receiving the golf club therein. A retainer secures the golf club within the shaft. An improper putt by a user of the device, gives the user immediate physical feedback with respect to the error committed.

20 Claims, 4 Drawing Sheets

PUTTING TRAINING DEVICE

BACKGROUND OF THE INVENTION

1. Field of the Invention

The present invention relates to a device that helps a golfer improve putting skills.

2. Background of the Prior Art

It has been said that if you conquer the skill of putting you have mastered the game of golf. While such a statement may not be entirely correct, being able to putt is a considerable advantage in golf. The putter is the only club that is consistently used on every hole with a few rare exceptions. It is also the club where finesse is paramount in shot delivery. Accordingly, putting practice requires long hours developing fine motors skills that allow exacting shot trajectory. While many golfers will spend such long hours on the putting practice greens, others will utilize various putting training aids that help develop the requisite muscle memory needed for superior putting skills.

Many such putting training aids are known in the art. These devices, which work with varying degrees of success, tend to suffer from one or more drawbacks. Many prior art devices are unusually complex in design and construction making such devices relatively expensive to manufacture and unnecessarily difficult to use and maintain. Other devices tend to have limited success in developing putting skills or are designed to develop only a component of the overall putting stroke.

Therefore, there exists a need in the art for a device that allows a golfer to develop and advance the golfer's putting skills, which device overcomes the above-stated shortcoming in the art. Specifically, such a device must be of relatively simple construction and design making the device relatively inexpensive to manufacture and easy to use and maintain. The device must allow the golfer to develop skills needed for the every component of the putting stroke in order to improve overall putting skills.

SUMMARY OF THE INVENTION

The putting training device of the present invention, addresses the aforementioned needs in the art. The putting training device allows a golfer to develop and advance the golfer's putting skills while being of relatively simple construction and design, thereby making the device relatively inexpensive to manufacture and easy to use and maintain. The present device allows the golfer to develop skills necessary for the entire putting stroke in order to improve overall putting skills.

The putting training device of the present invention is comprised of a first base member and a second base member connected by a shaft. A sleeve encompasses the shaft and slides along a length of the shaft and rotates about the shaft. A pocket is pivotally attached to the sleeve and is adapted to removably receive a golf club therein. A retainer secures the golf club within the pocket. The retainer may be a strap wherein a pair of cooperating hook and loop members are attached to opposing ends of the strap such that the strap encircles the pocket holding the golf club therein and the pair of hoop and loop members are cooperatively connected to one another for holding the golf club within the pocket. The pocket has a base member and an upwardly extending flange such that a sole of the golf club contacts the base member and a face of the golf club abuts the flange. The first base member has an aperture therethrough and the shaft passes through the aperture. The shaft has a hollow portion such that a laser emitting device is disposed within the hollow portion and laser light emitting from the laser emitting device to pass through the aperture.

BRIEF DESCRIPTION OF THE DRAWINGS

Similar reference numerals refer to similar parts throughout the several views of the drawings.

DESCRIPTION OF THE PREFERRED EMBODIMENT

Figure 1:
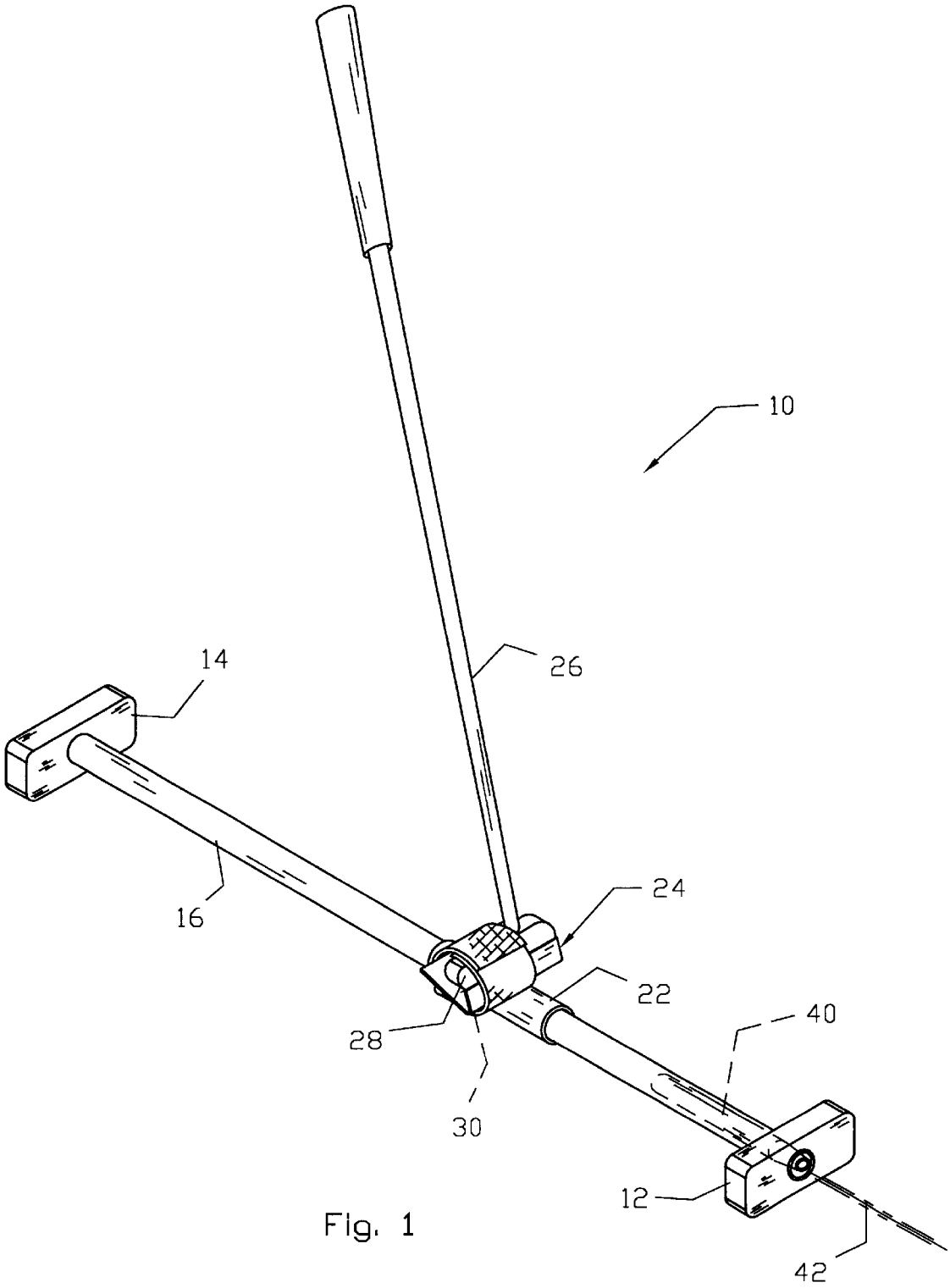
FIG. 1 is a perspective view of the putting training device of the present invention.
Figure 2:
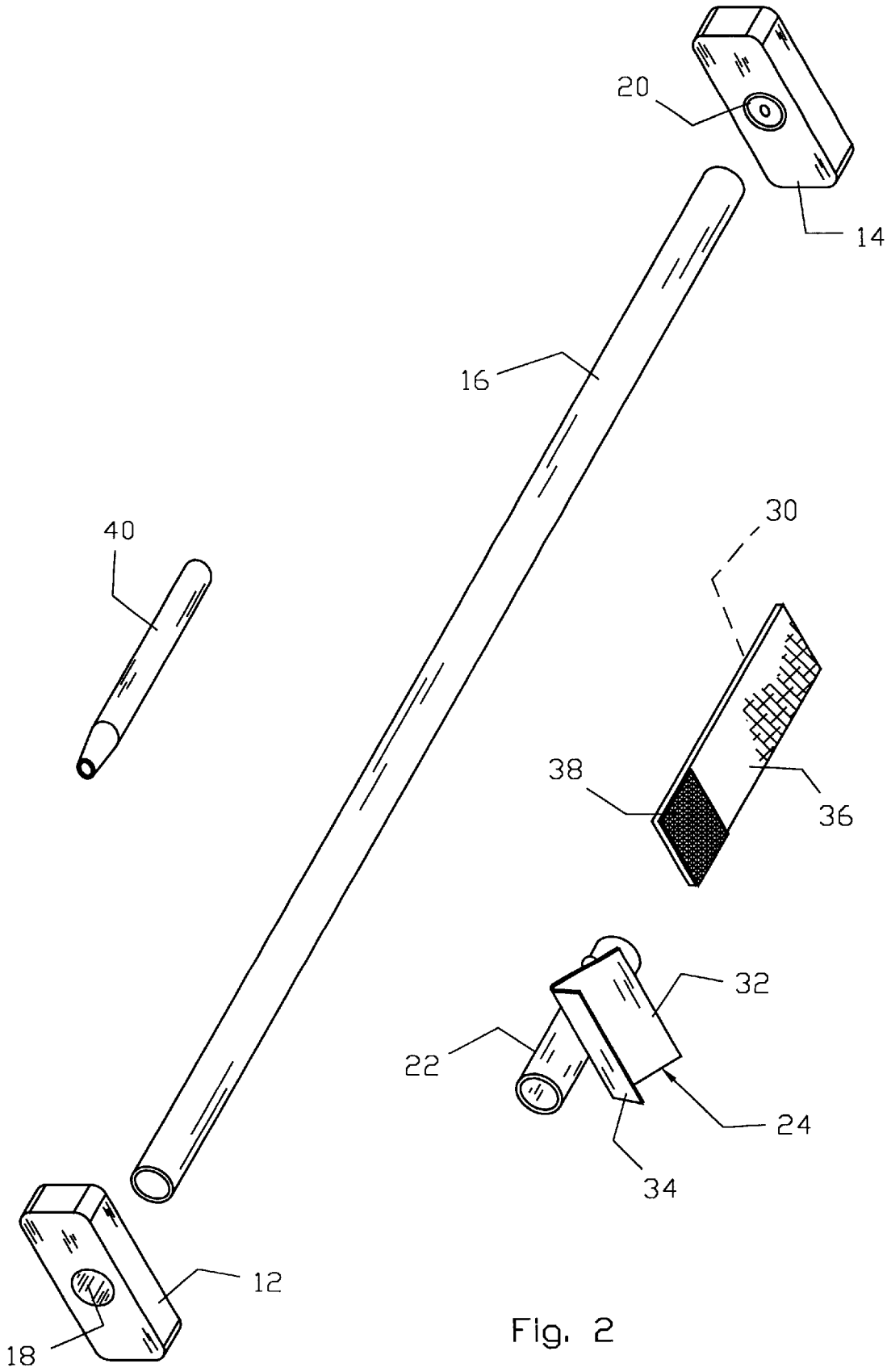
FIG. 2 is an exploded view of the putting training device.
Figure 3:
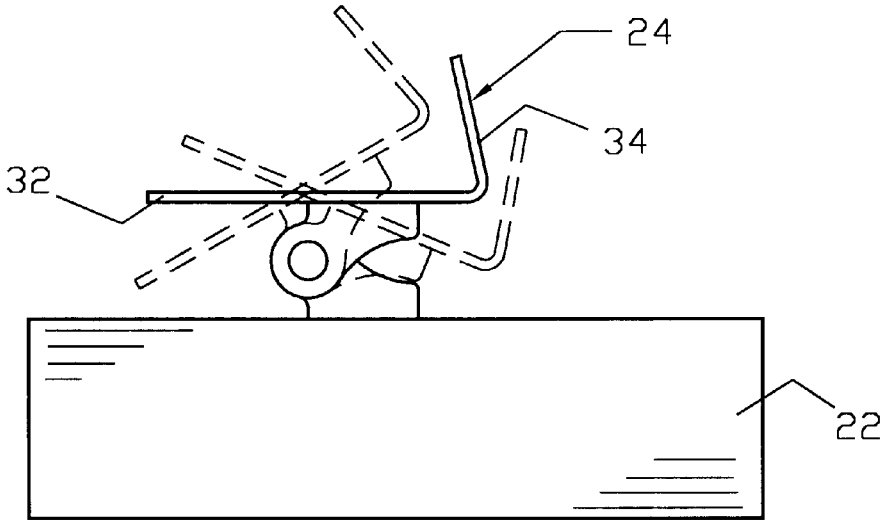
FIG. 3 is a side elevation view of the pocket system illustrating some of the positions through which the pocket can articulate.
Figure 4:
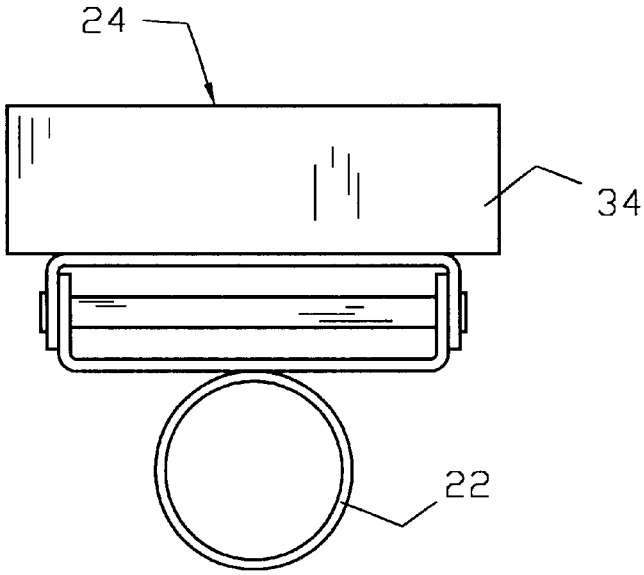
FIG. 4 is an end view of the pocket system.
Figure 5:
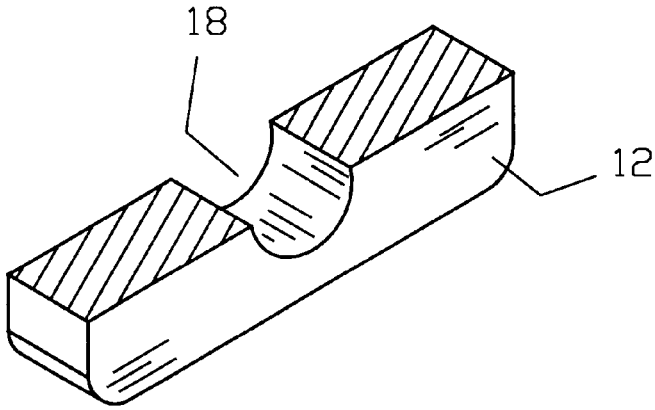
FIG. 5 is a sectioned view of the first base member.
Figure 6:
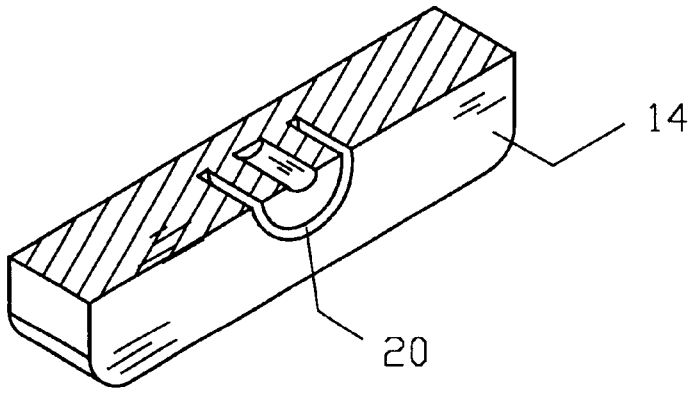
FIG. 6 is a sectioned view of the second base member.

Referring now to the drawings, it is seen that the putting training device of the present invention, generally denoted by reference numeral 10, is comprised of a first base member 12 and a second base member 14 connected by a shaft 16. The shaft 16 may be at least partially hollow. As seen, the first base member 12 has an aperture 18 that passes through the first base member 12 while a groove 20 is disposed within the second base member 14. An end of the shaft 16 is received within the aperture 18 of the first base member 12, the shaft 16 either partially or completely passing through the aperture 18, while the opposing end of the shaft 16 is received within the groove 20 of the second base member 14 and is friction held therein.

A sleeve 22 encompasses the shaft 16 and slides along a length of the shaft 16 and is also able to rotate about the shaft 16. A pocket 24 is pivotally attached to the sleeve 22 and receives a golf club 26 therein, the golf club 26 having a face 28 and a sole 30. The pocket 24 has a base member 32 and an upwardly extending flange 34 such that the sole 30 of the golf club 26 contacts the base member 32 and the face 28 of the golf club 26 abuts the flange 34. A retainer, of any appropriate design known in the art, such as a clip or the illustrated strap 36, secures the golf club 26 within the pocket 24. The strap 36 has a pair of cooperating hook and loop material members 38 thereon such that when the strap 36 is wrapped around the golf club 26, the hook and loop members 38 are used to secure the strap 36 thereabout. The hook and loop members 38 will be sufficiently sized in order to accommodate various sized golf clubs 26 within the pocket 24.

In order to use the putting training aid 10 of the present invention, the shaft 16 is positioned such that it is received within the aperture 18 of the first base member 12 and within the groove 20 of the second base member 14, such that the sleeve 22 encompasses the shaft 16. The two base members 12 and 14 are positioned on the ground. A putter 26 is received within the pocket 24 such that the sole 30 of the putter 26 rests on the base member 32 of the pocket 24 and a face 28 of the putter 26 abuts the flange 34 of the pocket 24. The retainer is used to secure the putter 26 within the pocket 24. If desired, a laser emitting device 40, of any appropriate design known in the art may be positioned within the hollow shaft 16 such that the laser beam 42 so emitted, emits through the aperture 18 of the first base member 12. Advantageously, the body of the laser emitting device 40 will be dimensioned such that it is received snugly within the hollow portion of the shaft 16 so that the laser beam 42 emitted by the laser emitting device 40 passes along the longitudinal axis of the shaft 16.

A user grasps the putter 26 and positions the putter 26 as desired including adjusting the pitch of the putter 24 (via the pocket's pivotal attachment to the sleeve 22 and also adjusts the roll of the putter 26 via rotation of the sleeve 22 about the shaft 16. Thereafter, the golfer attempts to make a putt in the usual way causing the sleeve 22 and pocket 24 laden putter 24 to slide along the shaft 16. If the user has correct form, the device 10 will allow the user to putt in normal fashion. However, should the user exhibit incorrect form, the putting training device 10 will either yaw or one or both of the base members 12 or 14 will buck depending on the type of error committed by the user. This will give the user immediate physical feedback on the putt and will allow the user to adjust the putt accordingly in order to achieve a better putter. The device 10 will be sufficiently light so that minor imperfections in a putting stroke will be captured by the putting training device 10 as it either twists or bucks or both. If the laser emitting device 40 is used, the laser beam 42 so emitted will shine upon the desired trajectory of the putt in order to give the user a visual target to aim for.

While the invention has been particularly shown and described with reference to an embodiment thereof, it will be appreciated by those skilled in the art that various changes in form and detail may be made without departing from the spirit and scope of the invention.

I claim:

1. A training device comprising:

a first base member;

a second base member;

a shaft connecting the first base member with the second base member, the shaft having a hollow portion;

a laser emitting device disposed within the hollow portion;

a sleeve encompassing the shaft and capable of sliding along a length of the shaft and rotating about the shaft;

a pocket pivotally attached to the sleeve, the pocket adapted to receive a golf club therein;

a retainer for securing the golf club within the pocket; and wherein when the golf club is received and secured in the pocket, the golf club can slide along the length of the shaft and rotate about the shaft.

2. The training device as in claim 1 wherein the first base member has an aperture therethrough and the shaft passes through the aperture.

3. The training device as in claim 1 wherein the retainer is a strap.

4. The training device as in claim 3 wherein a pair of cooperating hook and loop members are attached to opposing ends of the strap such that the strap encircles the pocket holding the golf club therein and the pair of hoop and loop members are cooperatively connected to one another for holding the golf club within the pocket.

5. The training device as in claim 1 wherein the pocket has a base member and an upwardly extending flange such that a sole of the golf club contacts the base member and a face of the golf club abuts the flange.

6. A training device comprising:

a first base member;

a second base member;

a shaft connecting the first base member with the second base member, the shaft having a hollow portion;

a laser emitting device disposed within the hollow portion;

a pocket system slidably attached to the shaft and capable of pitching with respect to an axis that is parallel to a longitudinal axis of the shaft and rotating about the shaft, the pocket system adapted to receive a golf club;

a retainer for securing the golf club within the pocket system; and wherein when the golf club is received and secured in the pocket system, the golf club can slide along the length of the shaft and rotate about the shaft.

7. The training device as in claim 6 wherein the first base member has an aperture therethrough and the shaft passes through the aperture.

8. The training device as in claim 6 wherein the retainer is a strap.

9. The training device as in claim 8 wherein a pair of cooperating hook and loop members are attached to opposing ends of the strap such that the strap encircles the pocket holding the golf club therein and the pair of hoop and loop members are cooperatively connected to one another for holding the golf club within the pocket.

10. The training device as in claim 6 wherein the pocket has a base member and an upwardly extending flange such that a sole of the golf club contacts the base member and a face of the golf club abuts the flange.

11. A training device in combination with a golf club, the golf club having a sole and a face, the training device comprising:

a first base member;

a second base member;

a shaft connecting the first base member with the second base member, the shaft having a hollow portion;

a laser emitting device disposed within the hollow portion;

a sleeve encompassing the shaft and capable of sliding along a length of the shaft and rotating about the shaft;

a pocket pivotally attached to the sleeve, the pocket receiving the golf club therein;

a retainer for securing the golf club within the pocket; and wherein when the golf club is received and secured in the pocket, the golf club can slide along the length of the shaft and rotate about the shaft.

12. The training device as in claim 11 wherein the first base member has an aperture therethrough and the shaft passes through the aperture.

13. The training device as in claim 11 wherein the retainer is a trap.

14. The training device as in claim 13 wherein a pair of cooperating hook and loop members are attached to opposing ends of the strap such that the strap encircles the pocket holding the golf club therein and the pair of hoop and loop members are cooperatively connected to one another for holding the golf club within the pocket.

15. The training device as in claim 11 wherein the pocket has a base member and an upwardly extending flange such that a sole of the golf club contacts the base member and a face of the golf club abuts the flange.

16. A training device in combination with a golf club, the golf club having a sole and a face, the training device comprising:

a first base member;

a second base member;

a shaft connecting the first base member and the second base member, the shaft having a hollow portion;

a laser emitting device disposed within the hollow portion;

a pocket system slidably attached to the shaft and capable of pitching with respect to an axis that is parallel to a longitudinal axis of the shaft and rotating about the shaft, the pocket system receiving the golf club;

a retainer for securing the golf club within the pocket; and wherein when the golf club is received and secured in the pocket, the golf club can slide along the length of the shaft and rotate about the shaft.

17. The training device as in claim 16 wherein the first base member has an aperture therethrough and the shaft passes through the aperture.

18. The training device as in claim 16 wherein the retainer is a strap.

19. The training device as in claim 18 wherein a pair of cooperating hook and loop members are attached to opposing ends of the strap such that the strap encircles the pocket holding the golf club therein and the pair of hoop and loop members are cooperatively connected to one another for holding the golf club within the pocket.

20. The training device as in claim 16 wherein the pocket has a base member and an upwardly extending flange such that a sole of the golf club contacts the base member and a face of the golf club abuts the flange.

* * * * *